US005217401A

United States Patent [19]

Watanabe et al.

[11] Patent Number: 5,217,401

[45] Date of Patent: Jun. 8, 1993

[54] METHOD OF MANUFACTURING A FIELD-EMISSION TYPE SWITCHING DEVICE

[75] Inventors: Masanori Watanabe, Katano; Hiroyuki Kado, Kadoma; Takao Chikamura, Osaka; Nobuyuki Yoshiike, Ikoma, all of Japan

[73] Assignee: Matsushita Electric Industrial Co., Ltd., Osaka, Japan

[21] Appl. No.: 836,558

[22] Filed: Feb. 18, 1992

Related U.S. Application Data

[62] Division of Ser. No. 550,097, Jul. 9, 1990, abandoned.

[30] Foreign Application Priority Data

Jul. 7, 1989 [JP] Japan ..... 1-175900

[51] Int. Cl.[5] ..... H01J 1/30; H01J 9/12

[52] U.S. Cl. ..... 445/24; 445/50; 313/309; 313/351

[58] Field of Search ..... 445/24, 50, 51; 313/336, 351, 309

[56] References Cited

U.S. PATENT DOCUMENTS

| | | | |
|---|---|---|---|
| 4,370,797 | 2/1983 | Van Gorkam et al. | 445/24 |
| 4,578,614 | 3/1986 | Gray et al. | 313/309 |
| 4,827,177 | 5/1989 | Lee et al. | 313/309 |
| 4,855,636 | 8/1989 | Busta et al. | 313/306 |
| 4,904,895 | 2/1990 | Tsukamoto et al. | 313/336 |
| 5,030,921 | 7/1991 | Kane | 313/336 |

FOREIGN PATENT DOCUMENTS

| | | |
|---|---|---|
| 0260075A2 | 4/1987 | European Pat. Off. . |
| 0290026A1 | 5/1988 | European Pat. Off. . |
| 0354750A2 | 8/1989 | European Pat. Off. . |

OTHER PUBLICATIONS

"The Electronics of the 21st Century", Vacuum Microelectronics, Henry F. Gray, The Naval Research Laboratory, Washington, D.C., Mar. 24, 1989, pp. 1-6.

*Primary Examiner*—Richard K. Seidel
*Assistant Examiner*—Jeffrey T. Knapp
*Attorney, Agent, or Firm*—Wenderoth, Lind & Ponack

[57] ABSTRACT

A field-emission type switching device includes a substrate formed with a recess having a straight edge and serrated edge opposite to the straight edge. A gate electrode is formed at the bottom of the recess. An emitter electrode is provided over the substrate and formed with a serrated edge which is slightly off alignment with the serrate edge of the recess so as to provide an emitter overhanging portion overhanging the recess. Similarly, a collector electrode is provided over the substrate means and formed with a straight edge which is slightly off alignment with the straight edge of the recess so as to provide a collector overhanging portion overhanging the recess. The emitter and collector electrodes are disposed in one plate and the gate electrode is disposed in another plane below the one plane.

1 Claim, 3 Drawing Sheets

METHOD OF MANUFACTURING A FIELD-EMISSION TYPE SWITCHING DEVICE

This application is a division of now abandoned application Ser. No. 07/550,097 filed on Jul. 9, 1990.

BACKGROUND OF THE INVENTION

1. Field of the Invention

The present invention relates to a super-high-speed switching device using a field-emission type cold cathode.

2. Description of the Prior Art

Research and development have been made recently on super-high-speed switching devices using a thin-film field-emission type cold cathode having the structure shown in FIG. 1 or on super-high-speed transistors. Insulation layer 22 is formed on the surface of silicon substrate 21, while gate electrode 24 having a hole 26 of 1–1.5 micrometer diameter and adjacent collector electrode 25 are formed on the insulation layer 22. During the making of hole 26, insulation layer 22 partly remains in a shape of a cone, and thereafter, a cone-shaped field-emission type cold cathode (hereinafter referred to as an emitter electrode) 23 is formed on the surface of silicon substrate 21. Accordingly, the emitter electrode 23 and the silicon substrate 21 are electrically connected. There is a 0.5–1 micrometer spacing and a 10–20 micrometer spacing provided between the tip of emitter electrode 23 and the gate electrode 24 and between emitter electrode 23 and collector electrode 25, respectively.

When the switching device is placed in vacuum and 80–100 V is fed to the gate electrode 24 with respect to the voltage of emitter electrode 23, more than $10^7$ V/cm of a high electric field is generated at the tip of the emitter electrode, thereby emitting electrons from emitter electrode 23, as shown by the dotted lines. The emitted electron beam enters into the collector electrode 25 so that the collector electrode 25 generates an electric signal relative to the emitted electron beam. An electron beam containing several-tens of electron volts of energy travels through a vacuum at $5\text{–}10\times10^8$ cm/second of speed. This is faster than the $5\times10^7$ cm/second of the maximum travel speed of an electron inside of a semiconductor by more than one order of magnitude. Accordingly, it is possible to provide a super-high-speed switching device having a switching speed faster than the switching speed of semiconductor devices, such as FETs, by more than one order of magnitude.

Although the switching device according to the prior art is capable of operating at a speed faster than that of the semiconductor switching device by more than one order of magnitude, there is a limit in the shortening of the operation time, because the prior art switching device has such a structure that the gate electrode 24 is inserted between the emitter electrode 23 and collector electrode 25. In other words, it is quite difficult according to the prior art switching device to make the spacing between the emitter electrode and the collector electrode less than 10 micrometers to shorten the electron-travel time.

Also, the rate of the electrons entering into the collector electrode is not always sufficient. Also, there is a defect in that the electron beam flows into other neighboring switching devices to cause crosstalk.

Furthermore, after forming the gate electrode and the collector electrode, it is necessary according to the prior art switching devices to go through complicated manufacturing processes such as making of a hole through the insulation layer 22 in order to form the cone-shaped emitter electrode by obliquely adhering vaporized high-melt-point metal like tungsten for example while rotating the entire substrate.

SUMMARY OF THE INVENTION

The object of the present invention is therefore to provide an imaging device which solves these problems.

The present invention has been developed with a view to substantially solving the above described disadvantages and has for its essential object to provide an improved electrophotographic imaging device.

The above mentioned object maybe achieved by providing a method for making a field-emission type switching device including the steps of: forming an insulation layer on a semiconductor substrate layer; forming an electrically conductive layer of said insulation layer; etching said electrically conductive layer to form an emitter electrode having a serrated edge and a collector electrode having a straight edge; etching said insulation layer through a space between said electrode and collector electrode so as to from a recess in said insulation layer such that an emitter overhanging portions formed overhanging recess and, at the same time, a collector overhanging portion is formed overhanging said recess; injecting ions at the bottom of said recess into said semiconductor substrate so as to form a gate electrode; and etching said overhanging portions to provide tapered edges;

wherein the serrated tip edge of the emitter electrode is left at a thickness within a range of 0.02–0.04 micrometer and wherein the point of contact of the emitter electrode with the insulation layer is maintained so as to be thick.

When 50 through 80 V of voltage is fed to the gate electrode adjacent to the emitter electrode, more than $10^7$ V/cm of a high electric field is generated at the tip of the emitter electrode, and then electrons are emitted. Part of the emitted electrons enter into the gate electrode, whereas majority of the electrons enter into the collector electrode provided in opposition to the emitter electrode, and thus, the electric signal added to the gate electrode can be modulated and transmitted to the collector electrode. The spacing between the emitter electrode and the collector electrode can be set less than one micron, and therefore, an extremely fast switching operation can be achieved.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

First Embodiment

Figure 2:
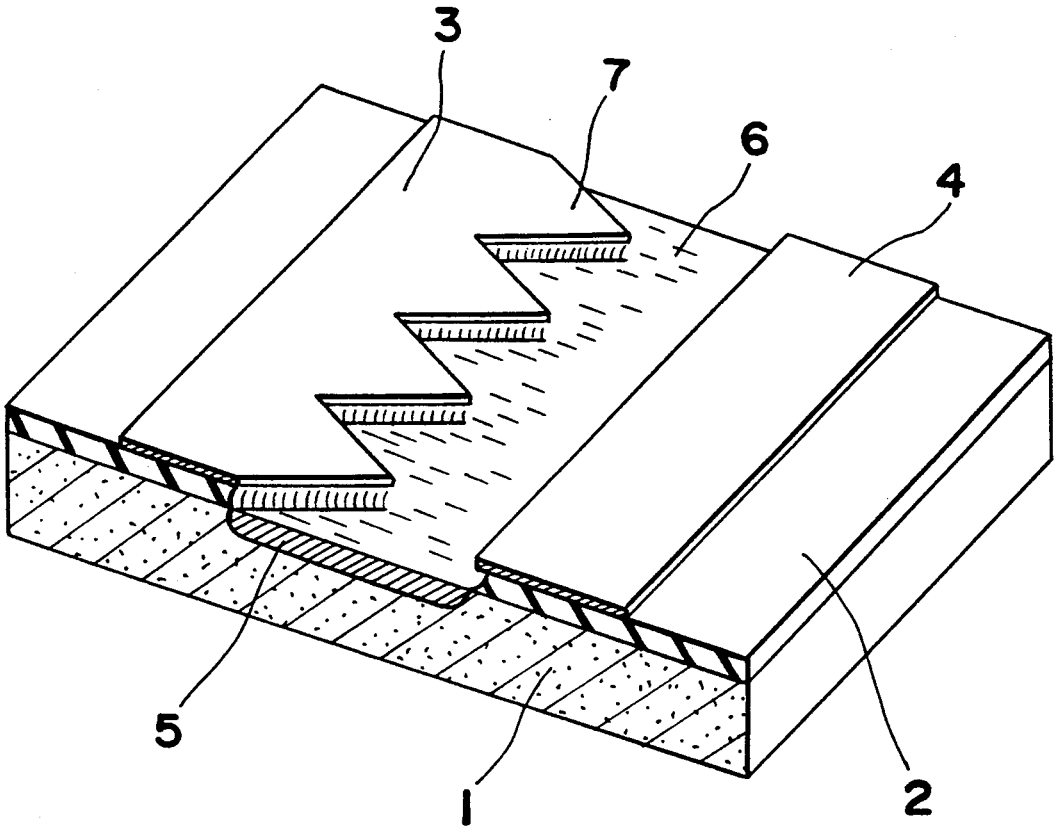
FIG. 2 illustrates a perspective view of the structure of essential electrodes of the field-emission type switching device according to a first embodiment of the present invention.

Referring to FIG. 2, a field-emission type switching device according to a first embodiment of the present invention is shown. The field-emission type switching device comprises a P-type silicon substrate 1 having a thickness of 300 micrometers and an insulation layer 2 made of silicon oxide film having a thickness of 0.5 micrometers formed on the P-type silicon substrate 1. The insulation layer 2 is partly removed to provide a recess 6. One edge of the recess 6 is straight and other edge opposite to the one edge is serrated. An emitter electrode 3 and a collector electrode 4 which are formed by a tungsten silicide ($WSi_2$) film with a thickness of 0.2 micrometer are provided on the insulation layer 2 such that emitter electrode 3 has a serrated edge 7 which is slightly off alignment towards the collector electrode 4 with the serrated edge of the recess 6, and collector electrode 4 has a straight edge which is slightly off alignment towards the emitter electrode 3 with the straight edge of the recess 6. Thus, the peripheral edge portion of the serrated edge 7 of the emitter 3 and the peripheral edge portion of the collector 4 extend over groove 6.

The bottom of groove 6, which is the surface of the silicon substrate 1 is formed with an n+ region by an ion-injection process, thereby defining a gate electrode 5.

Figure 4A:
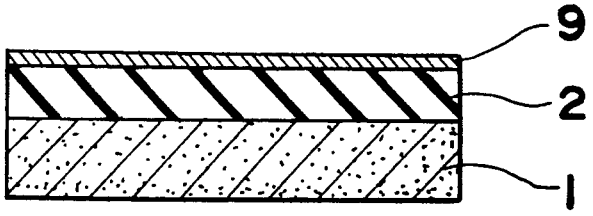
FIG. 4*a–e* illustrates steps for forming the field-emission type switching device shown in FIG. 2.

Referring to FIGS. 4*a–4e*, steps for forming the field-emission type switching device of FIG. 2 are shown. First, as shown in FIG. 4*a*, the insulation layer 2 made of a silicon oxide film having a thickness of 0.3–0.6 micrometers is formed on the surface of P-type silicon substrate 1, and then a $WSi_2$ film 9 having a thickness of 0.2 micrometers is formed on the surface of the insulation layer.

Figure 4B:
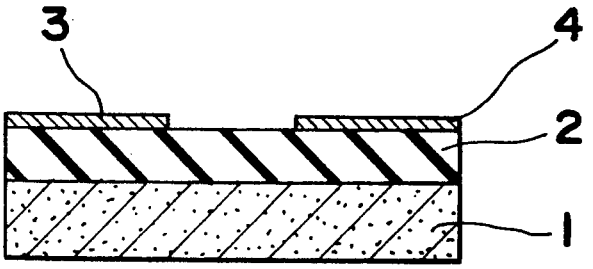

Then, as shown in FIG. 4*b*, the emitter electrode 3 and the collector electrode 4 are formed by the step of photolithographic etching, providing 1–3 micrometers, preferably 1.5 micrometers, of spacing between the tip of the serrated edge of emitter electrode 3 and the straight edge of collector electrode 4.

Figure 4C:
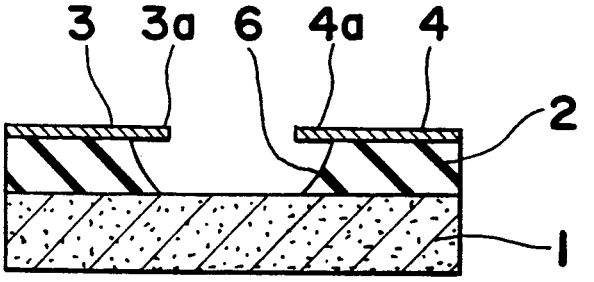

Then, as shown in FIG. 4*c*, the insulation layer 2 between electrodes 3 and 4 is removed by an etching process using a buffer etching solution, resulting in a formation of the recess 6. A peripheral edge portion 3*a* of the emitter electrode 3 and a peripheral edge portion 4*a* of the collector electrode 4 extend over the recess 6 as in eaves.

Figure 4D:
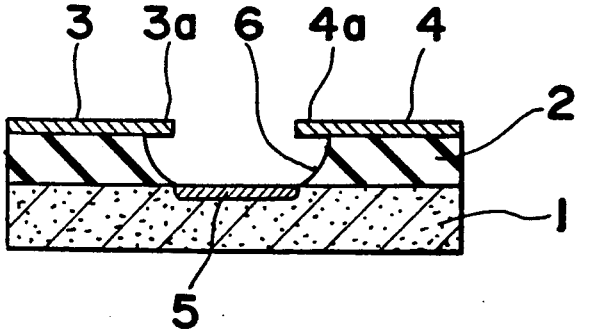

Then, as shown in FIG. 4*d*, by applying an ion-injection process, a low-resistance n+ layer is formed on the surface of the silicon substrate between both electrodes for making the gate electrode 5. A low-resistance p+ layer is formed when an N-type substrate is used.

Figure 4E:
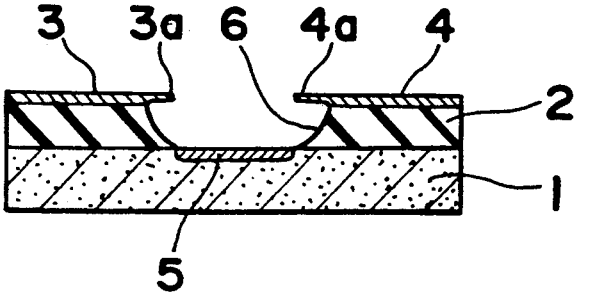

Then, as shown in FIG. 4*e*, the overhanging portions 3*a* and 4*a* are etched so as to provide a tapered edge.

Figure 1:
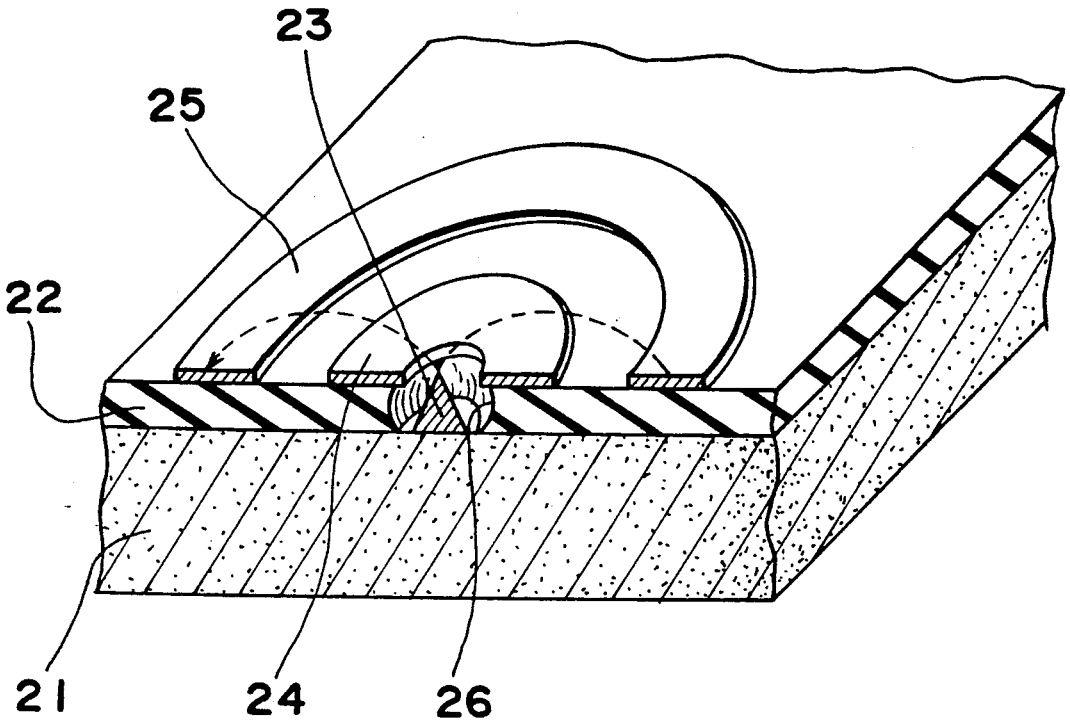
Fig. 1 PRIOR ART
FIG. 1 illustrates a cross-sectional view of the thin-film field-emission type switching device according to the prior art.
Figure 5:
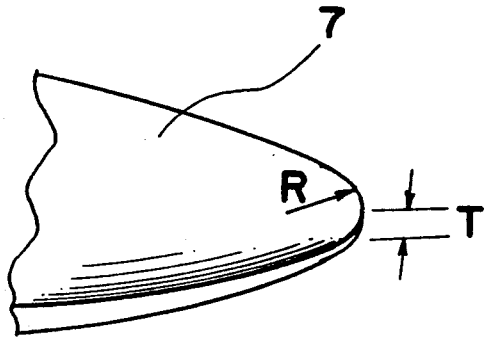
FIG. 5 illustrates a microscopic view of a tip of the serrated edge 7 of the device of FIG. 2.

From a microscopic viewpoint, as shown in FIG. 5, each pointed tip of the serrated edge 7 is rounded with a curvature radius R of 0.5–1 micrometers, and has a tapered edge thickness T of 0.02–0.04 micrometers. A sharp edge is particularly suitable for the intense and concentrated electrode emission from the emitter electrode 3. Since it is very difficult to obtain a sharp edge by reducing the curvature radius R, the sharp edge is obtained by making the tapered edge thickness T very thin.

In one operation mode, the emitter electrode 3 is connected to ground and the collector electrode 4 is supplied with 60 V. At this condition, no electrons are emitted from the emitter electrode 3. Then, when the gate electrode 5 is provided with a 50 V pulse, the emission of electrons from the emitter electrode 3 occurs during the pulse period. Thus, a negative pulse signal is generated at the collector electrode 4.

According to another operation mode, the emitter electrode 3 is connected to ground and when the collector electrode 4 is supplied with 80 V, the emitter electrode 3 emits electrons to cause an electron current to the flow to collector electrode 4. During such an electron current flow, when the gate electrode 5 is supplied with a −30 V pulse voltage, the electron current is cut off during the pulse period.

In this way, the current flowing between the emitter and collector electrodes can be turned ON and OFF in accordance with a voltage change at the gate electrode 5, thus providing a switching operation. Furthermore, the amplification of voltage and current can also be achieved. Thus, the field-emission type switching device according to the present invention can be used in the same way as the field-effect transistor formed by a semiconductor. The switching device of the present invention can provide less than 0.2 pico-second of the limit of the switching speed as determined by the travel time of electrons between the emitter and collector electrodes.

According to the first embodiment, a film made from silicon oxide is used for forming the insulation layer 2. Alternatively, the insulation layer 2 may be formed by such materials as $Si_3N_4$, $Ta_2O_3$, or $Al_2O_3$ having a high insulation property. As the thickness of the insulation layer 2 is made thinner, the operation becomes more sensitive to the change of voltage in the gate electrode 5. Thus, the drive voltage can be lowered. Furthermore, the material used for forming the emitter electrode is not limited to $WSi_2$, but materials such as W, Ta, and Mo having high melting point, or a carbide such as WC, TaC, ZrC, or SiC, or carbon, may also be used.

Second Embodiment

Figure 3:
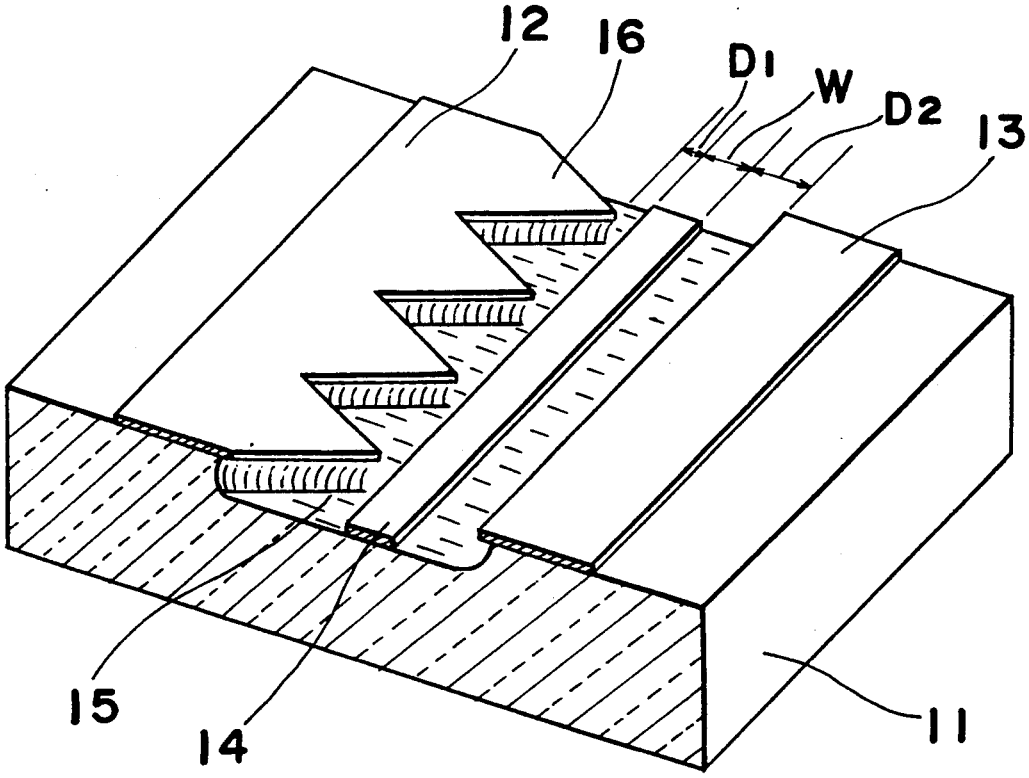
FIG. 3 illustrates a perspective view of the structure of essential electrodes of the switching device according to a second embodiment of the present invention.

Referring to FIG. 3 a field-emission type switching device according to a second embodiment of the present invention is shown. An emitter electrode 12 and collector electrode 13 are formed on the surface of a glass substrate 11. A recess 15 is formed in the glass substrate 11 between electrodes 12 and 13. A gate electrode 14 is disposed in recess 15. A distance D1 measured between the tip of the emitter electrode 12 and the gate electrode 14 is 0.5–1.0 micrometers, a distance D2 between the edge of the gate electrode 14 and the collector electrode 13 is 1–2 micrometers, and a width W of the gate electrode 14 is 0.5–1.0 micrometer. The switching device of the second embodiment operates in the same manner as that of the first embodiment, and a high speed and stable operation similar to that observed in the first embodiment is obtained. Furthermore, a level difference between the emitter and gate electrodes is 0.5–1.0 micrometers.

In the second embodiment, when the distance D1 is made shorter than distance D2, it is possible to improve the effect of the gate electrode. Furthermore, by making the distance D2 great, it is possible to increase the dielectric breakdown voltage between the gate and collector electrodes, thus making it possible to provide a switching device having a high amplification rate.

The switching device according to the present invention may be encapsulated by a suitable casing to provide the switching device in a vacuum condition, or in a non-active gas.

According to the field-emission type switching device of the present invention, since the distance between the emitter electrode and the collector electrode can be reduced to less than one-tenth the prior art switching device, the switching speed can be shortened more than one-tenth. Furthermore, no crosstalk occurs between adjacent devices, and yet, the invented switching device can be manufactured at at low cost.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is;

1. A method for making a field-emission type switching device comprising the steps of:

(a) forming an insulation layer on a semiconductor substrate layer;

(b) forming an electrically conductive layer over said insulation layer;

(c) etching said electrically conductive layer to form an emitter electrode having a serrated edge having at least one tip and a collector electrode having a straight edge;

(d) etching said insulation layer through a space between said emitter electrode and collector electrode as to form a recess in said insulation layer such that an emitter overhanging portion is formed overhanging said recess and, at the same time, a collector overhanging portion is formed overhanging said recess;

(e) injecting ions at the bottom of said recess into said semiconductor substrate so as to form a gate electrode; and (f) etching said overhanging portions to provide tapered edges;

wherein the at least one tip of the serrated edge of the emitter electrode is left at a thickness within a range of 0.02–0.04 micrometer and wherein the point of contact of the emitter electrode with the insulation layer is maintained so as to be thick.

* * * * *